US006154906A

United States Patent [19]

Erli

[11] Patent Number: 6,154,906

[45] Date of Patent: Dec. 5, 2000

[54] PORTABLE UNIT FOR CHANGING CLOTHES OF A BABY OR CARRYING OUT PERSONAL HYGIENE OF THE SAME

[75] Inventor: Pierangelo Erli, Bergamo, Italy

[73] Assignee: Stamp S.R.L., Italy

[21] Appl. No.: 09/411,282

[22] Filed: Oct. 4, 1999

[30] Foreign Application Priority Data

Jan. 19, 1999 [IT] Italy ..... MI9900026

[51] Int. Cl.[7] ..... A47D 5/00; A47D 13/00

[52] U.S. Cl. ..... 5/655; 5/95; 4/572.1

[58] Field of Search ..... 5/655, 94, 93.1; 190/1, 2; 4/572.1, 659

[56] References Cited

U.S. PATENT DOCUMENTS

| | | | |
|---|---|---|---|
| 1,005,709 | 10/1911 | Jackson | 190/1 |
| 2,842,781 | 7/1958 | Hoffman | 5/655 |
| 2,933,735 | 4/1960 | O'Connor | 4/572.1 |
| 3,269,621 | 8/1966 | Dishart | 5/655 |
| 4,733,836 | 3/1988 | Barnes | 5/655 |
| 4,742,900 | 5/1988 | Boxhammer | 190/2 |
| 4,781,277 | 11/1988 | Lim | 5/655 |
| 5,215,172 | 6/1993 | Stevenson | 5/655 |
| 5,299,336 | 4/1994 | Marteeny | 5/655 |

*Primary Examiner*—Alexander Grosz
*Attorney, Agent, or Firm*—Robert F. I. Conte; Lee, Mann, Smith, McWilliams, Sweeney & Ohlson

[57] ABSTRACT

A portable unit for changing clothes of a baby comprises a substantially stiff base body (2) adapted to support the body of a lying baby and a pair of movable wings (5) rotatably engaged on opposite sides of the base body (2) and shiftable between a closed position in which the movable wings (5) are superposed on the base body (2) and an operating open position in which the movable wings (5) are disposed externally of said base body.

19 Claims, 4 Drawing Sheets

FIG. 1
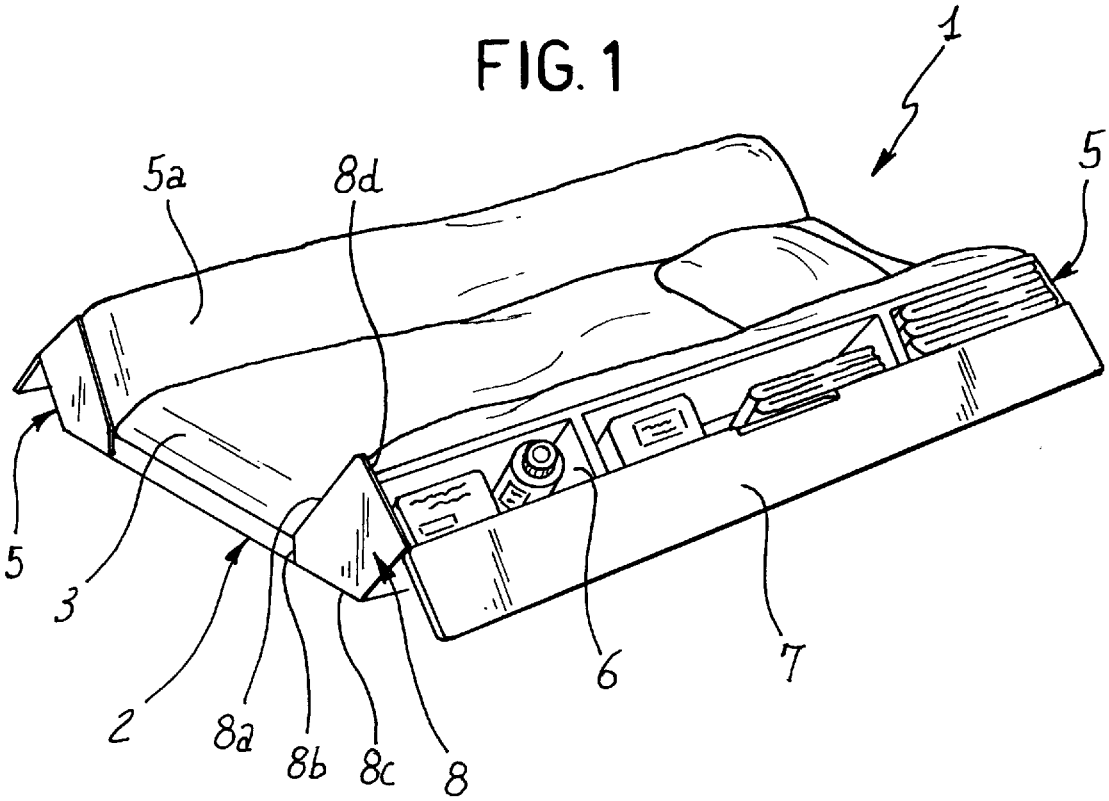
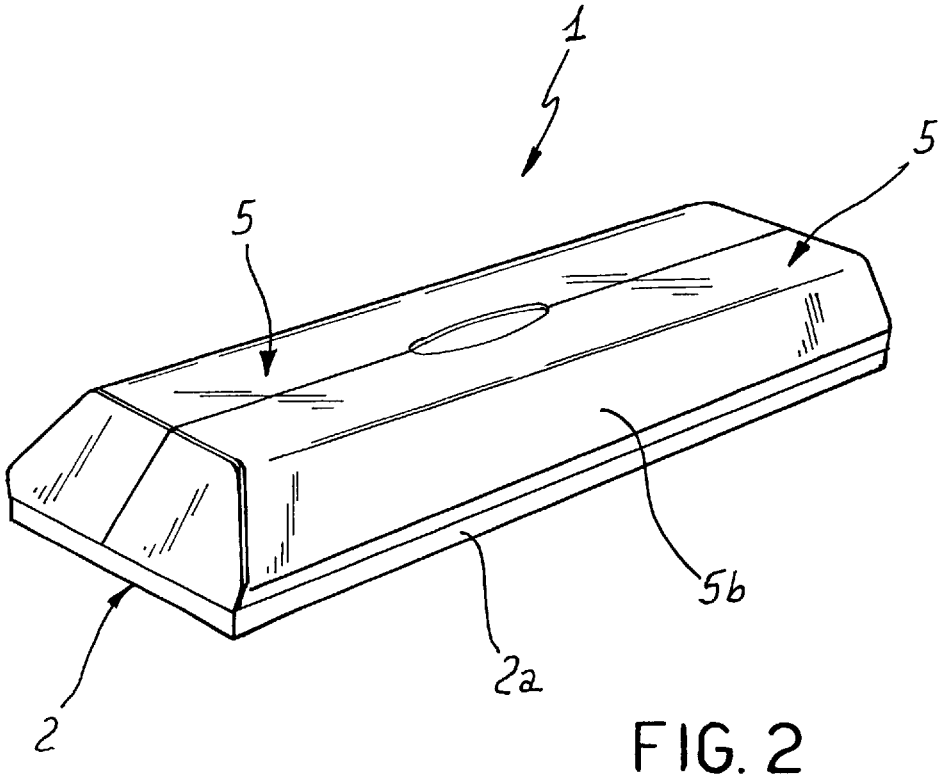
FIG. 2

FIG. 3
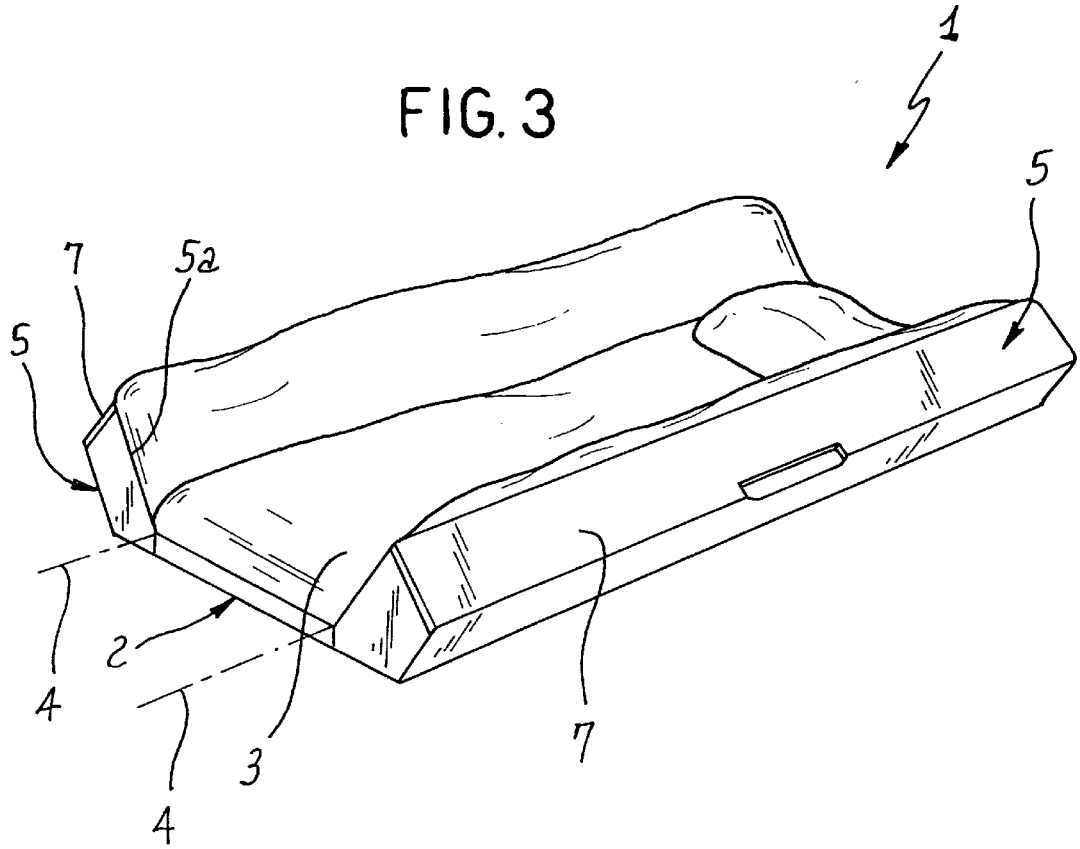
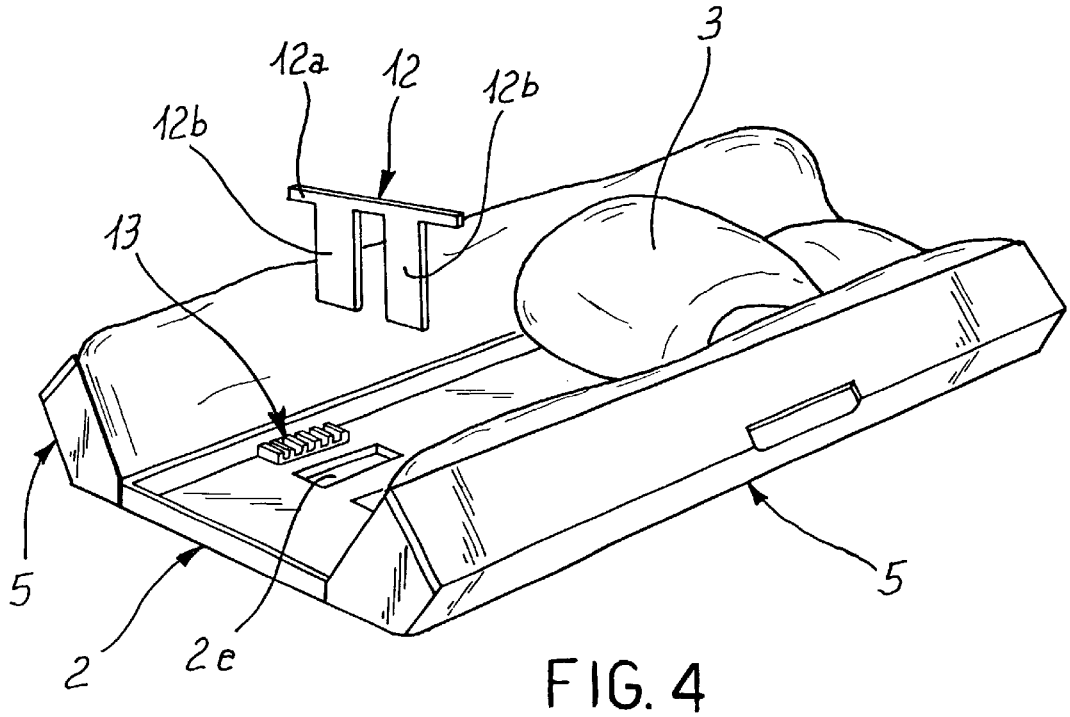
FIG. 4

PORTABLE UNIT FOR CHANGING CLOTHES OF A BABY OR CARRYING OUT PERSONAL HYGIENE OF THE SAME

FIELD AND BACKGROUND OF THE INVENTION

The present invention relates to a portable unit for changing clothes of a baby or carrying out personal hygiene of the same.

It is known that for facilitating diaper changing operations in a baby, conveniently equipped units can be used which substantially consist of a preferably padded base which is adapted to support the lying baby's body and which has at least lateral side panels.

These equipped units, if they are of the portable type, generally have the appearance of a bag made of flexible plastic material for example, which is opened for use so as to provide, in addition to object-carrying compartments, a non-rigid flat portion intended for forming the rest surface.

Use of a portable bag-shaped unit of the above mentioned type needs provision of an appropriate support surface because, due to the flexibility of the materials forming it, it must be supported over the whole lower surface thereof when extended in the operating open position.

The required availability of said support surface may often constitute under particular situations, on a journey for example, an insurmountable hindrance greatly limiting practical and widespread use of these portable units.

In addition, although the above described equipped units are provided with a support surface, they may not be safer when they are subjected to dangerous displacements over the support surface itself, due to the baby's movements.

Also known are facilities for changing clothes of a baby which are a non-portable type and consist of stiff structures to be placed astride the sides or edges of a cot or a small bath or to be secured to an appropriate stand.

The last-mentioned facilities, while being practical and steady, are not adapted for transport due to their bulkiness. In addition, they are not generally provided with spaces or compartments to keep all objects normally used for changing clothes of a baby in an orderly and gathered manner.

SUMMARY OF THE INVENTION

It is a general aim of the present invention to provide a portable unit for changing clothes of a baby or carrying out personal hygiene of the same and which is capable of overcoming the limits of portable units of known type and non-transportable facilities.

The specified aim and object are substantially achieved by a portable unit for changing clothes of a baby or carrying out personal hygiene of same, comprising a substantially stiff base body adapted to support the body of a lying baby and a pair of movable wings rotatably in engagement, on opposite sides, with said base body and shiftable between a closed position in which the movable wings are superposed on the base body itself and an operating open position in which the movable wings are disposed externally of said body.

BRIEF DESCRIPTION OF THE DRAWINGS

Description of a preferred embodiment of a portable unit for changing clothes of a baby in accordance with the invention is now given hereinafter by way of nonlimiting example and illustrated in the accompanying drawings, in which:

FIG. 1 is a perspective view of the unit in accordance with the invention in a completely open position;

FIG. 2 is a perspective view of the unit in FIG. 1 in a closed position;

FIGS. 3 and 4 show two intermediate opening steps of the unit, before fastening to a bathtub;

DESCRIPTION OF THE PREFERRED EMBODIMENT

Figure 5:
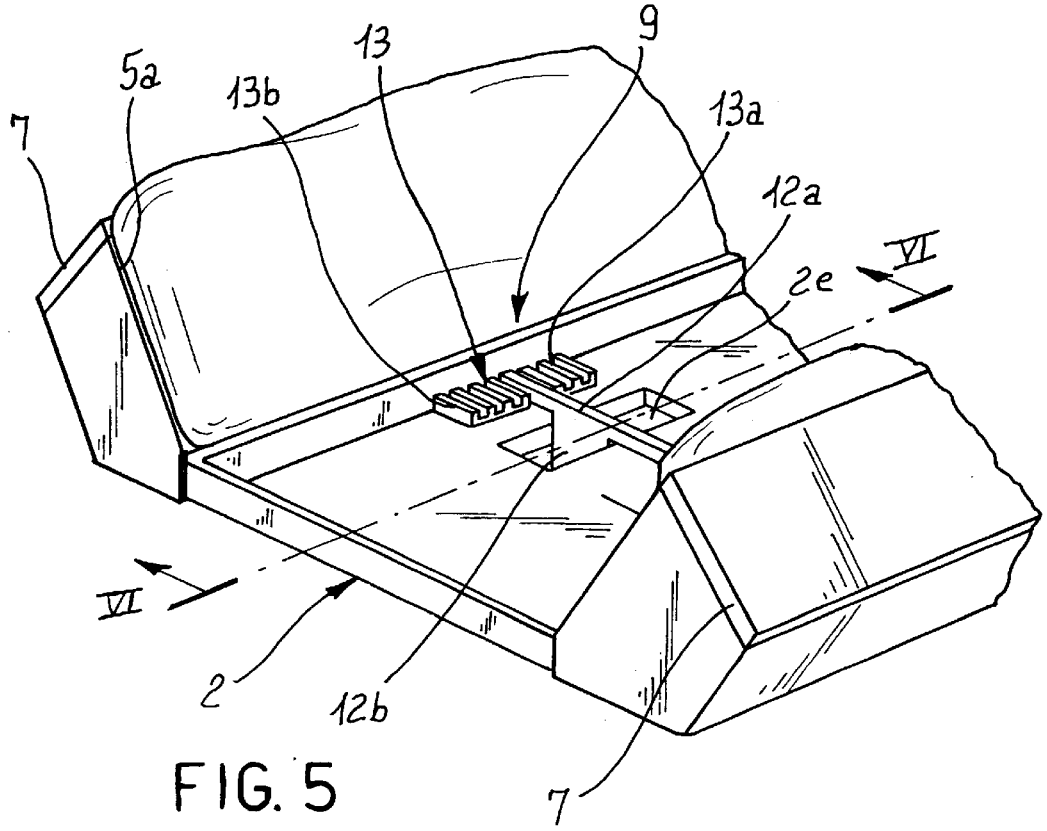
FIG. 5 shows means for anchoring the unit in FIG. 1 to a bathtub or the sides of a cot.

With reference to the drawings, the portable unit for changing clothes of baby in accordance with the invention has been generally identified by reference numeral 1. It comprises a substantially rigid and flat base bodycoated on top with a padding or a removable mat 3 and being sized, for example to support a lying baby weighing 15 kg at most.

Disposed the longitudinal sides 2*a* of the base body 2, are two movable wings 5. The wings are in rotatable engagement with the base body 2, around rotation axes 4 (FIG. 3) and are shiftable between a closed position in which they are superposed on said body (see FIG. 2) and an operating open position (see FIGS. 1 and 3) in which they are disposed externally of the base body 2 so as to define a pair of lateral-containment side panels.

More particularly, the movable wings 5 have inner faces 5*a* suitably coated with a padded cover and superposed on mat 3 in a closed position. When the movable wings 5 are in the open operating position the faces 5*a* are inclined at an obtuse angle relative to the surface defined by the base body 2.

In addition, the movable wings 5 are completely hollow and have object-holders 6 which are adapted to house the materials habitually used for baby-changing operations. The hollow wings are closed by doors 7 can be provided, which are adapted to house the material habitually used for baby-changing operations.

Preferably, each of the movable wings 5 has a transverse profile or end wall 8 substantially shaped in the form of a right-angled trapezium comprising a major base 8*a* corresponding to the inner face 5*a* and a vertex 8*b* corresponding to the intersection between the major base itself 8*a* and the oblique side 8*c*, substantially disposed at the rotation axis 4.

The angle formed by the oblique side 8*c* defining an outer face 5*b* (FIG. 2) with the major base 8*s* is to be suitably selected so that, when said outer face 5*b* is aligned with the plane defined by the base body 2, the inner face 5*a* is inclined to the latter at the desired obtuse angle. In addition, disposed close to side 8*d* orthogonal to the trapezium base is door 7.

Thus, the above described unit can be used for clothes changing or personal hygiene of a baby by merely laying it down on a table or another appropriate support.

Advantageously, also provided is anchoring means 9 for the base body 2 and a support 10 employed during use for holding up an end portion 2*b* of the base body 2 itself.

Figure 6:
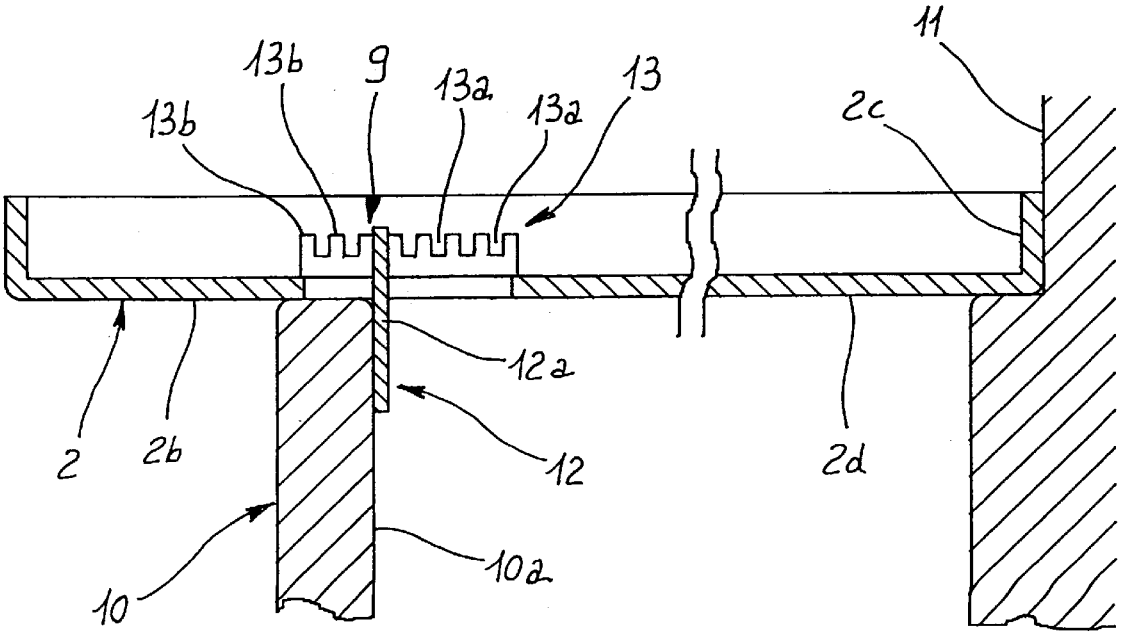
FIG. 6 is a section taken along plane VI—VI in FIG. 5 with the unit applied to the bathtub.

Referring to FIGS. 4–6, the support 10 can be defined, for example, by the front vertical wall of a bathtub on the upper edges of which unit 1 bears, forming a bridge over it, in such a manner that the rear edge 2*c* of the base body 2 abuts against a surface 11 of the wall to which the bathtub is applied.

The anchoring means 9 comprises an abutment element 12 to be operatively disposed at a position projecting from the lower surface 2*d* of the base body 2 and adapted to abut against a vertical region 10*a* of support 10.

In addition, the anchoring means 9 comprises adjustment members 13 for the abutment element 12 adapted to fasten the latter to a plurality of positions distributed along the longitudinal-extension direction of the base body 2, so that the abutment element itself 12 can be always disposed close to said vertical region 10*a* of support 10 irrespective of the distance of the support from the abutment surface 11.

More specifically, the abutment element 12 has a substantially fork-shaped conformation comprising a crosspiece 12*a* and two tailpieces 12*b* insertable in a pair of longitudinal slits 2*e* formed in the base body 2.

The adjustment members 13 comprise a plurality of seats 13*a* made up of two elements having rectangular teeth 13*b*, integral with the base body 2 and disposed sideways with respect to slits 2*e*.

The shape of seats 13*a* matches that of the section of the crosspiece 12*a*, so that the latter is locked when fitted in said seats.

Figure 7:
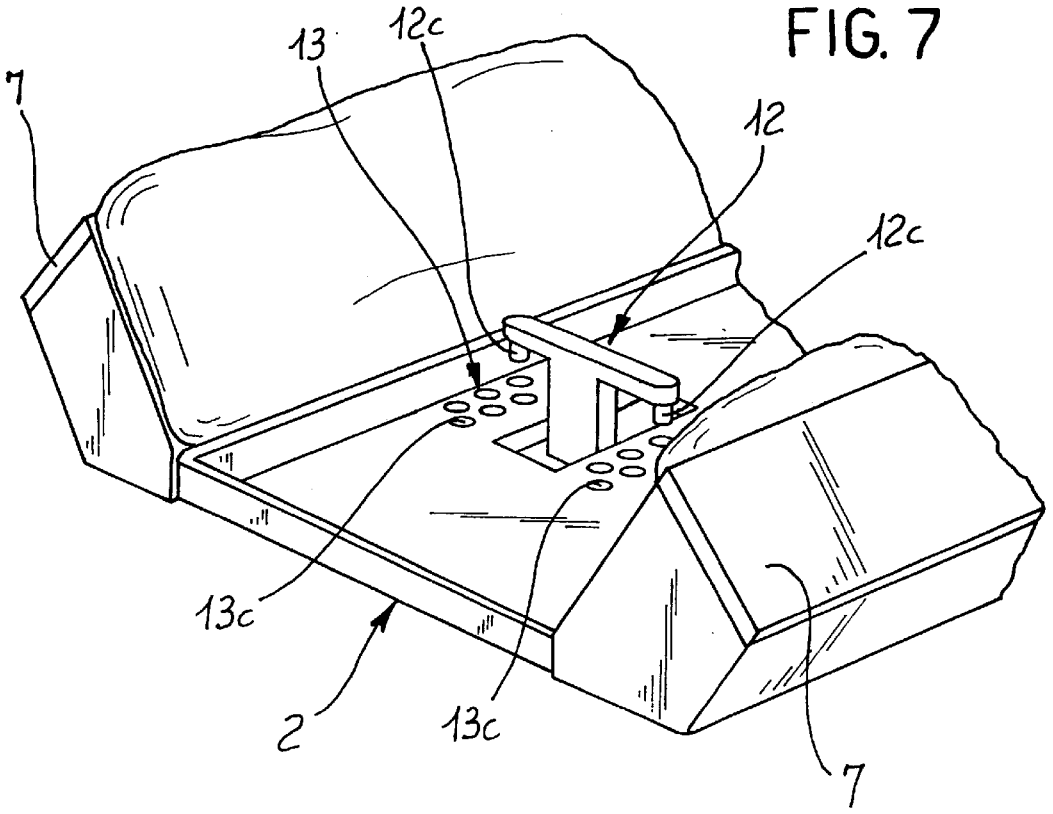
FIG. 7 shows an alternative embodiment of the anchoring means.

In accordance with an alternative embodiment of FIG. 7, the abutment elements 12 has pins 12*c*, extending downwardly from the crosspiece 12*a*, whereas the adjustment members 13 has corresponding holes 13*c* formed in the base body 2.

Advantageously, for a finer adjustment and better adaptation to the bathtub, holes 13*c* may be arranged in echelon formation.

Figure 8:
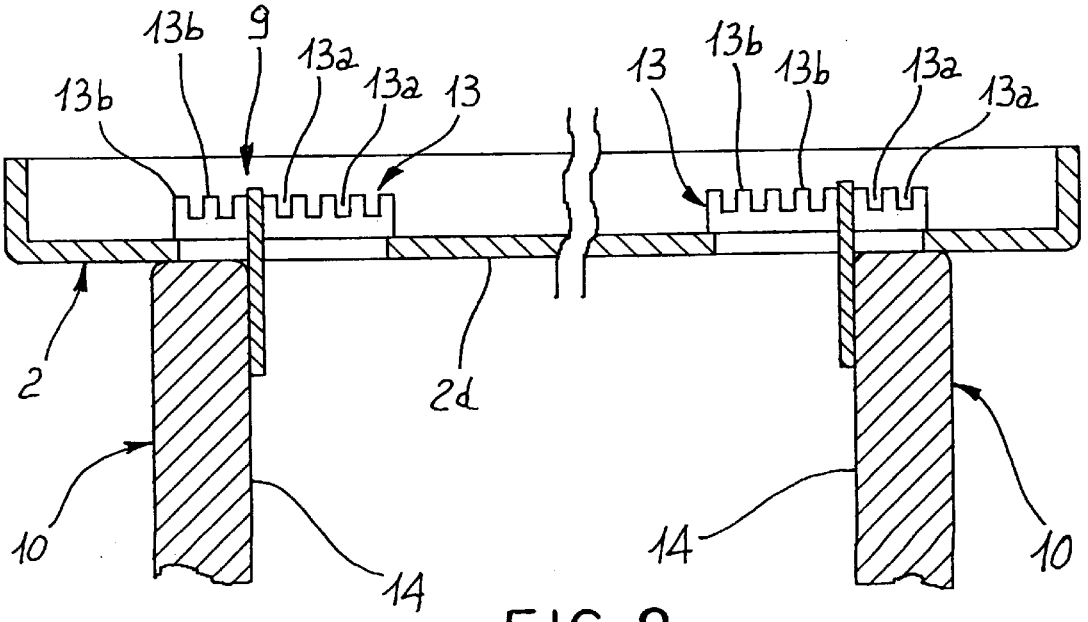
FIG. 8 is a sectional view of the anchoring means of the unit in FIG. 1 applied to a cot's sides.

With reference to FIG. 8, there is illustrated still another embodiment where the portable unit 1 is provided with dual anchoring means 9 to enable application to a cot. In this case support 10 is embodied by the opposite sides 14 of the cot.

Use of a portable unit for changing clothes to a baby, described above mainly as regards structure, is as follows.

For transportation, the movable wings 5 are placed in superposed relationship with the base body 2 so that the unit becomes an object of reduced and handy bulkiness.

When the unit is to be used, availability of a true support surface is not required because, due to the base body stiffness, it is sufficient for said base body to be supported at two end portions.

For instance, the base body may be advantageously placed on the upper edges of a bathtub pushing the rear edge 2*c* thereof against the abutment surface 11 of the wall adjoining the tub (see FIG. 6), or on the opposite sides 14 the cot (FIG. 8).

Afterwards, for unit opening, the movable wings 5 are rotated until their outer faces 5*b* are brought in abutment against said upper edges of the tub and therefore in alignment with the plane defined by the base body 2 (see FIG. 3).

Subsequently, the anchoring means 9 is set up by fitting the abutment element 12, after partly raising mat 3, into the longitudinal slits 2*e*, taking care to choose those seats 13*a* of the crosspiece 12*a* that are adapted to position tailpieces 12*b* as close as possible to the vertical region 10*a* of the bathtub front wall acting as a support (see FIGS. 5 and 6).

Alternatively, fastening of unit 1 can be obtained by fitting pins 12*c* into corresponding holes 13*c*.

When this quick and simple preparatory step has been completed, the unit is ready for baby-changing operations.

The above-described equipped portable unit is very versatile as it can be used without particular rest surfaces being available but merely making use of the edges of a bathtub or the sides of a cot, for example.

In addition it is very steady and it is not subjected to displacements during the baby-changing operations as it can be easily fastened to the support on which it rests.

Finally, the unit in accordance with the invention, due to its folding movable wings, enables a reduced bulkiness to be obtained, when closed, as compared with units of rigid structure of the non-transportable type, the dimensions of the base body rest surface being the same.

What is claimed is:

1. A portable unit for changing clothes of a baby or carrying out personal hygiene of said baby, comprising:

a substantially stiff base body (2) adapted to support the body of a lying baby, said base body (2) is substantially flat, a pair of movable wings (5) rotatable in engagement, on opposite sides of said base body (2) and shiftable between a closed position in which the movable wings (5) are superimposed on the base body itself and an operating open position in which the movable wings (5) are disposed externally of said body, said movable wings (5) are rotatably engaged around rotation axes (4) disposed at the longitudinal sides (2*a*) of the base body itself in a manner adapted to define, in said operating open position, a pair of lateral-containment side panels, and a pair of movable wings (5) rotatably in engagement, on opposite sides, with said base body (2) and shiftable between a closed position in which the movable wings (5) are superimposed on the base body itself and an operating open position in which the movable wings (5) are disposed externally of said body, said movable wings (5) each have an inner face (5*a*) substantially superposed on said base body (2) in said closed position, and in that in said operating open position said inner face (5*a*) is inclined at an obtuse angle relative to the surface defined by the base body.

2. The unit as claimed in claim 1, wherein said movable wings (5) are provided with at least one closable object-holding space (6).

3. The unit as claimed in claim 1, further comprising anchoring means (9) of said base body (2) and a support (10) to be employed when the unit is in use, for bearing an end portion 2*b* of the base body itself thereon.

4. The unit as claimed in claim 3, wherein said anchoring means (9) comprises an abutment element (12) to be operatively disposed in a position at which it projects from the lower surface (2*d*) of said base body (2) and adapted to abut against a substantially vertical region (10*a*) of said support (10).

5. The unit as claimed in claim 1, wherein each of said movable wings (5) has a transverse profile substantially in the form of a right-angled trapezium.

6. A portable unit for changing clothes of a baby or carrying out personal hygiene of said baby, comprising:

a pair of movable wings (5) rotatably in engagement, on opposite sides of said base body (2) and shiftable between a closed position in which the movable wings (5) are superimposed on the base body itself and an operating open position in which the movable wings (5) are disposed externally of said body, anchoring means (9) of said base body (2) and a support (10) to be employed when the unit is in use, for bearing an end portion 2(*b*) of the base body itself thereon, said anchoring means (9) comprises an abutment element (12) to be operatively disposed in a position at which it projects from the lower surface (2*d*) of said base body (2) and adapted to abut against a substantially vertical region (10*a*) of said support (10), and said anchoring means (9) comprises adjustment members (13) for said abutment element (12) adapted to fasten said element to the base body (2) in a plurality of positions distributed along the longitudinal-extension direction of the base body itself.

7. The unit as claimed in claim 5, wherein said abutment element (12) has a substantially fork-shaped conformation comprising a crosspiece (12*a*) and two tailpieces (12*b*) insertable in a pair of longitudinal slits (2*e*) formed in the base body (2).

8. The unit as claimed in claim 7, wherein said adjustment member (13) comprise a plurality of seats (13*a*) adapted to house and lock said crosspiece in said plurality of positions.

9. The unit of claim 7, wherein said base body (2) is substantially flat and said movable wings (5) are rotatably engaged around rotation axes (4) disposed at the longitudinal sides (2*a*) of the base body itself in a manner adapted to define, in said operating open position, a pair of lateral-containment side panels.

10. The unit of claim 9, wherein said movable wings (5) are provided with at least one closable object-holding space (6).

11. The unit as claimed in claim 6, wherein said adjustment member (13) comprise a plurality of seats (13*a*) adapted to house and lock said crosspiece in said plurality of positions.

12. The unit of claim 11 wherein said base body (2) is substantially flat and said movable wings (5) are rotatably engaged around rotation axes (4) disposed at the longitudinal sides (2*a*) of the base body itself in a manner adapted to define, in said operating open position, a pair of lateral-containment side panels.

13. The unit of claim 12 wherein said movable wings (5) are provided with at least one closable object-holding space (6).

14. The unit as claimed in claim 6, wherein said abutment element comprises pins (12*c*) intended for fitting into holes (13*c*) formed in the base body (2) and constituting said adjustment members (12).

15. The unit as claimed in claim 14, wherein said holes (13*c*) are arranged in echelon formation.

16. The unit of claim 14 wherein said base body (2) is substantially flat and said movable wings (5) are rotatably engaged around rotation axes (4) disposed at the longitudinal sides (2*a*) of the base body itself in a manner adapted to define, in said operating open position, a pair of lateral-containment side panels.

17. The unit of claim 16 wherein said movable wings (5) are provided with at least one closable object-holding space (6).

18. The unit of claim 6 wherein said base body (2) is substantially flat and said movable wings (5) are rotatably engaged around rotation axes (4) disposed at the longitudinal sides (2*a*) of the base body itself in a manner adapted to define, in said operating open position, a pair of lateral-containment side panels.

19. The unit of claim 18 wherein said movable wings (5) are provided with at least one closable object-holding space (6).

* * * * *